US007645969B2

(12) United States Patent
Gnemmi et al.

(10) Patent No.: US 7,645,969 B2
(45) Date of Patent: Jan. 12, 2010

(54) LOW VOLTAGE DEVICE FOR THE GENERATION OF PLASMA DISCHARGE TO OPERATE A SUPERSONIC OR HYPERSONIC APPARATUS

(75) Inventors: Patrick Gnemmi, Saint-Louis (FR); Christian Rey, Mulhouse (FR)

(73) Assignee: Institut Franco-Allemand de Recherches de Saint-Louis, Saint-Louis (FR)

( * ) Notice: Subject to any disclaimer, the term of this patent is extended or adjusted under 35 U.S.C. 154(b) by 552 days.

(21) Appl. No.: 11/525,169

(22) Filed: Sep. 22, 2006

(65) Prior Publication Data

US 2007/0200028 A1 Aug. 30, 2007

(30) Foreign Application Priority Data

Sep. 27, 2005 (FR) ..... 05 09831

(51) Int. Cl.
*B64C 23/00* (2006.01)

(52) U.S. Cl. ..... 244/3.1; 60/203.1; 102/501

(58) Field of Classification Search ..... 244/3.1, 244/3.21, 171.5, 35 A; 60/203.1; 313/231.31; 102/501

See application file for complete search history.

(56) References Cited

U.S. PATENT DOCUMENTS

| | | | | |
|---|---|---|---|---|
| 3,325,123 | A * | 6/1967 | Null | 244/166 |
| 3,392,941 | A * | 7/1968 | Cason III | 244/3.21 |
| 5,183,956 | A * | 2/1993 | Rosenberg | 89/8 |
| 5,273,237 | A * | 12/1993 | Guyton et al. | 244/52 |
| 6,145,298 | A * | 11/2000 | Burton, Jr. | 60/202 |
| 6,367,735 | B1 * | 4/2002 | Folsom et al. | 244/3.22 |
| 7,002,126 | B2 | 2/2006 | Gnemmi et al. | |

FOREIGN PATENT DOCUMENTS

| | | |
|---|---|---|
| FR | 0212906 | 10/2002 |

* cited by examiner

*Primary Examiner*—Rob Swiatek
(74) *Attorney, Agent, or Firm*—Oliff & Berridge, PLC.

(57) ABSTRACT

A method, device, and projectile having a device for guiding or piloting projectiles or missiles (self-propelled or non-self-propelled), to deflect, in a direction Y, a hypervelocity projectile operating in a gas, such as a shell, a bullet, or a missile, having a nose, generally in the shape of a cone, with a more or less pointed tip, by generating a first high-voltage discharge able to produce a plasma over a first limited sector of the projectile surface and in direction Y, maintaining the plasma, and generating another low-voltage discharge able to supply the plasma with energy over a second limited sector of the projectile surface and in direction Y, the first and the second sectors being different and may overlap.

22 Claims, 7 Drawing Sheets

LOW VOLTAGE DEVICE FOR THE GENERATION OF PLASMA DISCHARGE TO OPERATE A SUPERSONIC OR HYPERSONIC APPARATUS

BACKGROUND OF THE INVENTION

1. Field of Invention

The present invention relates to the field of arrangements for guiding or piloting projectiles or missiles (self-propelled and non-self-propelled), and relates to a method and associated device for guiding a projectile such as, for example, a shell, a bullet, or a missile.

2. Description of Related Art

Guidance of a projectile flying through the thermosphere, i.e. practically in vacuum, can be effected with a plasma thruster as described in U.S. Pat. No. 3,151,259.

Guidance of a projectile flying through the atmosphere, e.g., the troposphere, can be effected for example by deploying airfoils or by the operation of a pyrotechnic device.

The main drawback of airfoils resides in their deployment, which involves considerable forces proportional to the velocity of the projectile and due to its resistance to very high pressures encountered at supersonic speeds. Moreover, this type of guidance requires a lengthy reaction time which may be a major drawback if the projectile is spin-stabilized and which hampers its maneuverability.

For a flying projectile, the main drawback of guidance by operation of a pyrotechnic device is that it can operate only once.

The prior art aimed at overcoming these drawbacks is disclosed in French Patent Application FR0212906 which describes a method of deflecting, in a direction Y, a hypervelocity projectile such as a shell, a bullet, or a missile, having a nose, generally cone-shaped, with a more or less pointed tip, characterized by effecting a plasma discharge over a limited sector of the outer surface of the nose in direction Y.

SUMMARY OF THE INVENTION

This patent application also describes an exemplary embodiment for implementing a method having a triggered spark gap, two electrodes, and a high-voltage generator.

FIG. 1 shows the breakdown voltage $V_d$ between two plane electrodes at an inter-electrode distance d of 1 cm apart and placed in an enclosure containing nitrogen, as a function of pressure p. The breakdown voltage is the minimum voltage whose application causes breakdown between the electrodes; after the breakdown, an arc forms which becomes a conducting medium connecting the electrodes. In part II of the curve, $V_d$ obeys Paschen's law and is a function only of pressure p of the medium multiplied by inter-electrode distance d. At the two ends I and III, the curve departs from this law. The voltages are sufficiently high for the electrical field at the surface of the electrodes to rip off electrons. Part I corresponds to the vacuum in which the plasma thrusters operate; in this part, $V_d$ is practically independent of p*d.

Analysis of this figure shows that, in the troposphere, hence between ground and altitude 16-17 km, where the surrounding static pressure $P_0$ is greater than $10^4$ Pa and where, in view of the velocity V of the projectile, the pressure P at the surface of its tip is greater than $P_0$, a high voltage is necessary for breaking through the dielectric barrier between two electrodes supplied with current. Thus, part III corresponds to high pressures, higher than atmospheric pressure at ground level, particularly the pressure P prevailing at the tip of the projectile in supersonic flight.

Thus, to ensure substantial deflection of the projectile with a device according to French Patent 0212906, it is necessary to generate a plasma for a sufficient amount of time, typically about a few milliseconds. However, with most of the high-voltage generators currently available on the market, such a time cannot be attained in a single discharge (because a high-voltage discharge is inherently a short-duration phenomenon) and several successively closely spaced pulses have to be generated. Now, it is found that, with these generators, the closer the voltage pulses generated are spaced, the more the intensity of these pulses wanes; hence the need to oversize the generating means and thus increase their weight, which causes a drag on the speed and therefore decreases the effectiveness of the projectile.

The goal of the invention is to overcome these drawbacks by providing a method for guiding a hypervelocity (e.g., supersonic) projectile that has no moving parts, which can be repeatedly implemented as necessary, and enables a plasma to be generated for a sufficient amount of time with no need to oversize the voltage generator.

The solution provided by exemplary embodiments can include a method for deflecting, in a direction Y, a hypervelocity projectile (e.g., a shell, a bullet, or a missile) operating in a gas and having a generally cone-shaped nose with a more or less pointed tip, characterized in that the method includes generating a first high-voltage discharge able to produce a plasma over a first limited sector of the projectile surface and in direction Y, maintaining the plasma, and generating another low-voltage discharge able to supply the plasma with energy over a second limited sector of the projectile surface and in direction Y, the first and second sectors being different and may overlap.

The maintenance or increase in ionization of the plasma over the second sector will be referred to as "supplying the plasma with energy."

In accordance with a first exemplary embodiment, the plasma is supplied with energy over the second sector for at least one millisecond.

According to a second exemplary embodiment, a method for deflecting, in a direction Y, a hypervelocity projectile operating in a gas and having a generally cone-shaped nose with a more or less pointed tip, can include the steps of effecting at least a first voltage discharge T1 between a first set of at least a first and a second electrode (e.g., FIG. 6, elements A and B) delimiting the first limited sector of the projectile surface in direction Y, the discharge being able to break through the dielectric barrier between the first set of electrodes (A; B), then applying a voltage T3 between the first set of electrodes (A; B) able to generate a plasma, and applying at least a voltage T2 between a second set of at least two electrodes (e.g., FIG. 6, elements B and C) delimiting the second limited sector of the projectile outer surface in direction Y, voltage T2 being able to supply the plasma with energy.

In accordance to the second exemplary embodiment, voltage T2, applied between the second set of electrodes is generated over the second sector, at least a part of which is further away from the end of the projectile's nose than the first sector.

The method according to the second exemplary embodiment, wherein the first voltage discharge T1 is a high-voltage discharge with low energy (e.g., less than a decijoule) for generating a low-energy plasma over the first sector, the low-energy plasma serving as a sliding contact switch over the second sector where a high-energy plasma is obtained.

According to the second exemplary embodiment, the method can further include maintaining the low-energy plasma over the first sector, preferably with at least one low-voltage discharge T3.

In further accordance to the second exemplary embodiment, voltage discharge T2 can include a low-voltage and medium-energy discharge (e.g., higher than one Joule).

High voltage and low voltage are understood as a voltage higher than 1000 V (i.e., 1 kV) and a voltage lower than 1000 V, respectively.

According to a third exemplary embodiment, a method for deflecting, in a direction Y, a hypervelocity projectile operating in a gas and having a generally cone-shaped nose with a more or less pointed tip, can include the steps of generating at least one first high-voltage discharge of at least 5 kV able to break through the dielectric barrier present between a first and a second electrode (in accordance to Paschen's law) to generate a plasma, and generating at least one second low-voltage discharge of less than 1000 V able to supply the plasma with energy.

In accordance to the third exemplary embodiment, the method can include generating a single high-voltage discharge and several successive low-voltage discharges.

In accordance to the third exemplary embodiment, the method can include generating a plasma over a first limited sector of the projectile nose and maintaining this plasma on a second limited sector of the projectile nose.

According to a fourth exemplary embodiment, a device for guiding a hypervelocity projectile (e.g., a shell, a bullet, or a missile) having a generally cone-shaped nose and a more or less pointed tip, the device can include at least one group of at least three electrodes disposed at the outer surface of the projectile, of which preferably a first set of at least one first and one second electrode delimit a first sector between them and are connected to a first means able to generate a plasma between the first set of electrodes and at least one third electrode being, with a fourth electrode or with one of the first set of electrodes, connected to a second means able to supply the plasma with energy, and delimiting between them a second sector which has, relative to the first sector, at least one part located at a greater distance from the projectile nose.

In accordance with the fourth exemplary embodiment, at least first, second, and third electrodes are aligned longitudinally, preferably in direction M parallel to the straight-line movement of the projectile.

In accordance with the fourth exemplary embodiment, the first and second means each can include a low-voltage generator and at least one low-voltage capacitor.

According to the fourth exemplary embodiment, the first means is able to generate, between the first and second electrodes, at least one high-voltage discharge T1 followed by preferably a low-voltage discharge T3, the first means being preferably able to store a small amount of energy (e.g., less than a decijoule) for the high voltage discharge and about one Joule for the low voltage discharge.

According to the fourth exemplary embodiment, the second means is able to generate a low-voltage discharge T2, the second means being preferably able to store a large amount of energy (e.g., greater than or equal to 5 Joules).

According to a fifth exemplary embodiment, a hypervelocity projectile (e.g., a shell, a bullet, or a missile) having a generally cone-shaped nose and a more or less pointed tip, the projectile having a device for guiding the projectile, the device can include at least one group of at least three electrodes disposed at the outer surface of the projectile, of which preferably a first set of at least one first and one second electrode delimit a first sector between them and are connected to a first means able to generate a plasma between the first set of electrodes and at least one third electrode being, with a fourth electrode or with one of the first set of electrodes, connected to a second means able to supply the plasma with energy, and delimiting between them a second sector which has, relative to the first sector, at least one part located at a greater distance from the projectile nose.

BRIEF DESCRIPTION OF THE DRAWINGS

Other advantages and features will emerge from the description of particular embodiments of the invention with reference to the attached drawings.

DETAILED DESCRIPTION OF PREFERRED EMBODIMENTS

During flight, an expansion wave is produced upstream of a hypervelocity projectile's nose. When the projectile is flying along a straight-line trajectory, the pressures distributed over its surface are balanced and the expansion wave has symmetries following the shape of the projectile. In the case of a projectile having a conical nose, the wave attaches to the tip of the cone and is conical in shape.

Figure 2:
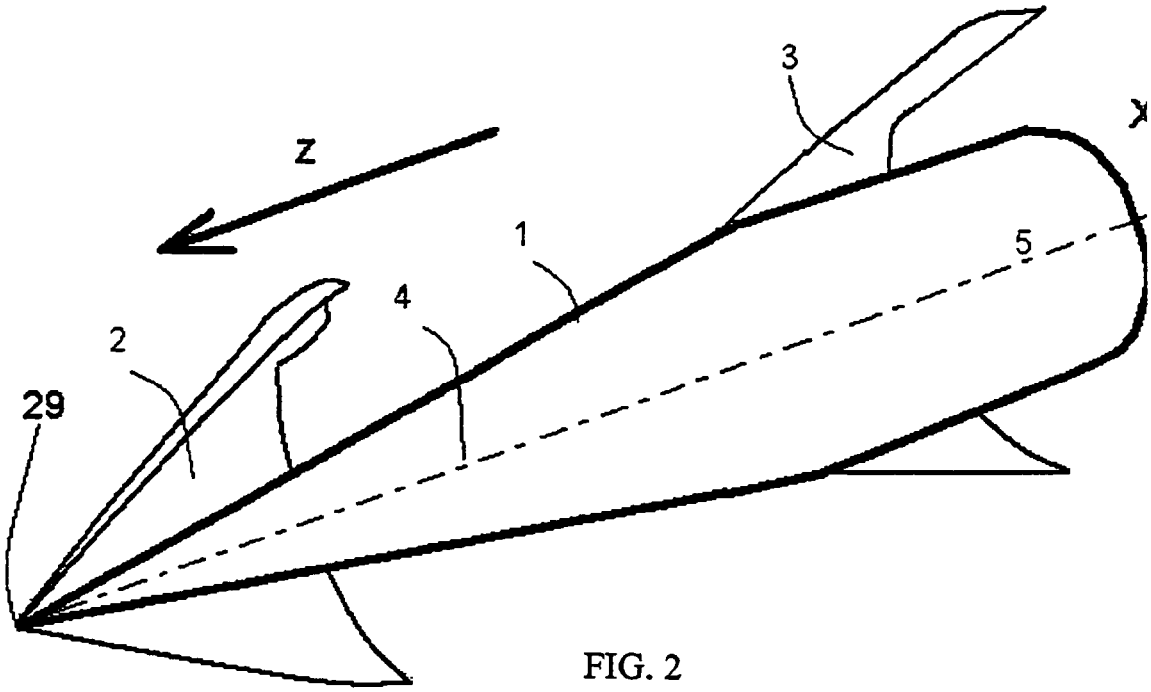
FIG. 2 illustrates a diagram of the expansion wave at the nose generated by a supersonic projectile and the expansion wave due to the discontinuity in the surface of the projectile.
Figure 1:
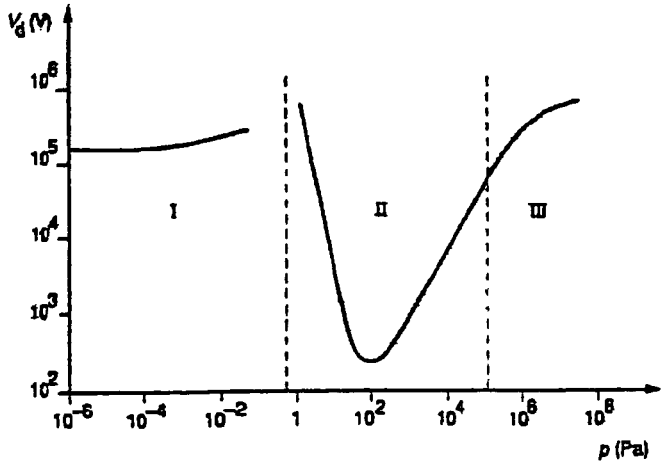
FIG. 1 shows the breakdown voltage between two plane electrodes.

FIG. 2 shows the result of a digital simulation of a projectile (e.g., projectile 1) with lengthwise axis X flying at supersonic speed in the direction Z of the arrow. It shows integrally projectile 1 and half of two other surfaces 2 and 3. The projectile has a conical front part 4 and a cylindrical rear part 5. Surfaces 2 and 3 characterize a constant pressure in the flow. Surface 2 attached to the tip of the projectile represents the surface of the conical expansion wave while surface 3 attached to the discontinuity of the projectile surface (cone-cylinder junction) characterizes an expansion wave.

The invention applied to such a projectile consists of unbalancing the flow around the nose of the projectile, producing a plasma discharge, for example at end 29 of the nose nearest the tip, to change the angle of attack. This plasma discharge, effected over a limited angular sector, modifies the boundary layer surrounding the surface of the projectile. Hence the objective is to produce such a discharge that the unbalancing of the thermodynamic values is sufficient to deflect the projectile from a straight-line trajectory.

The absence of moving parts and the repetitive nature of the discharges are the main advantages of this technique. The trajectory of the projectile can be controlled by repeated discharges activated on demand according to the desired trajectory.

Figure 3:
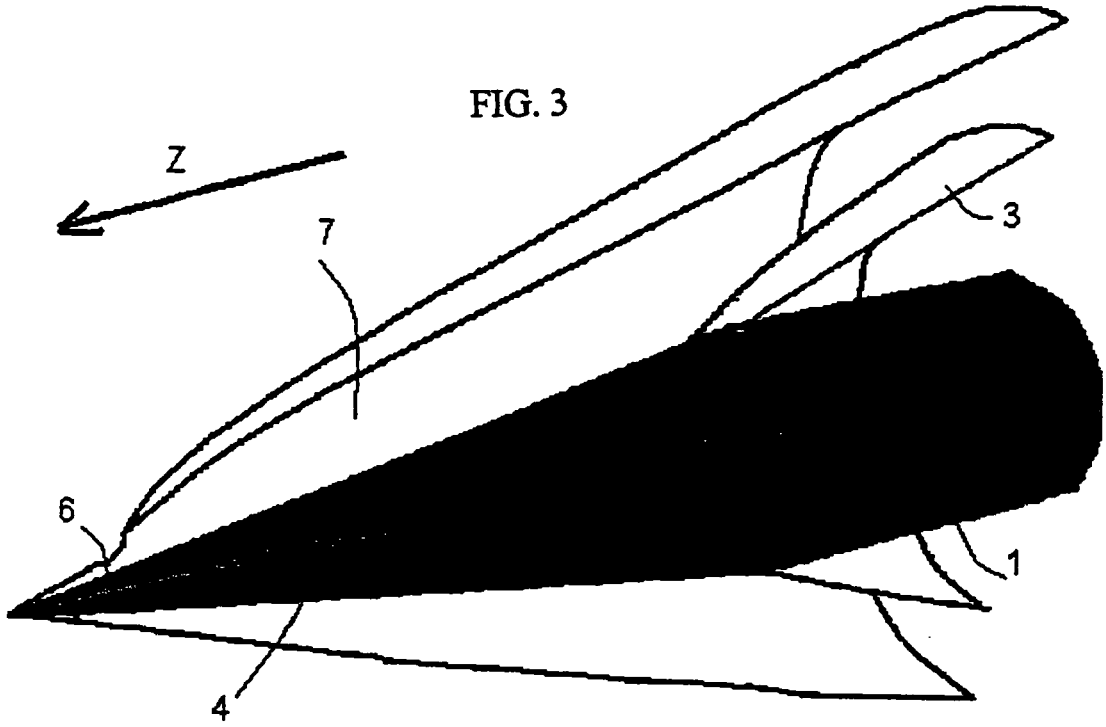
FIG. 3 shows the result of a digital simulation of the supersonic projectile, operating under the same supersonic flight conditions as in FIG. 2, to which a plasma discharge is applied.

FIG. 3 shows the results of a digital simulation of the same projectile operating under the same supersonic flight conditions as before, to which a plasma discharge is applied near the tip. Each of expansion wave surfaces 7 and 3 characterizes a constant pressure in the flow.

As shown at the tip of projectile 1, expansion wave surface 7 is deflected under the influence of plasma discharge 6.

Figure 4:
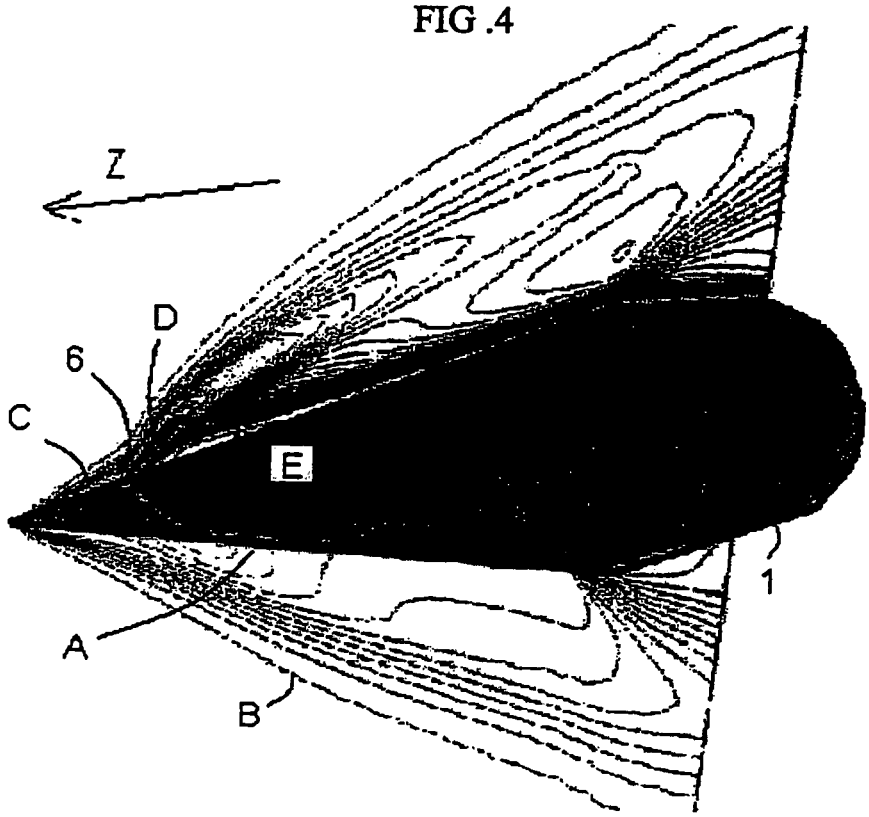
FIG. 4 shows the asymmetry of the distribution of the density of the surrounding air on half of the projectile's surface and in the plane of flow symmetry for the example chosen.

FIG. 4 shows the asymmetric distribution of the density of the surrounding air over half the projectile surface and in the flow plane of symmetry for the example chosen. This density is substantially constant and is equal to 1 $kg/m^3$ between points A and B located opposite plasma discharge 6 and downstream, relative to direction Z of the projectile, of the plasma discharge (zone C) while it is very low (approximately $2.7\times10^{-2}$ $kg/m^3$) at the skin E of the projectile upstream of plasma discharge 6. On the other hand, it is at a maximum, approximately 3 $kg/m^3$, at point D at plasma discharge 6.

Figure 5:
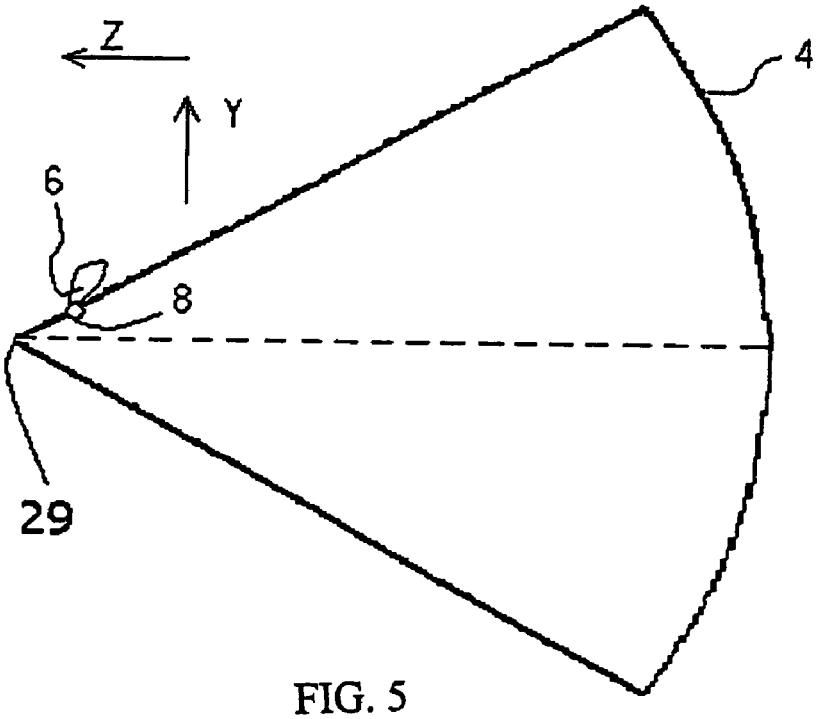
FIG. 5 illustrates a diagram of the device according to an exemplary embodiment.

FIG. 5 is a diagram of part of a projectile according to one embodiment of the invention. This part has a cone-shaped nose 4 of a hypervelocity projectile. Near tip 29 of the nose is a plasma discharge 6.

To deflect the projectile in a direction Y perpendicular to the lengthwise axis of the projectile, in a first step a plasma discharge 6 is effected over a limited sector 8 of the outer surface of the nose and, in a second step, plasma discharge 6 is supplied with energy.

Figure 6:
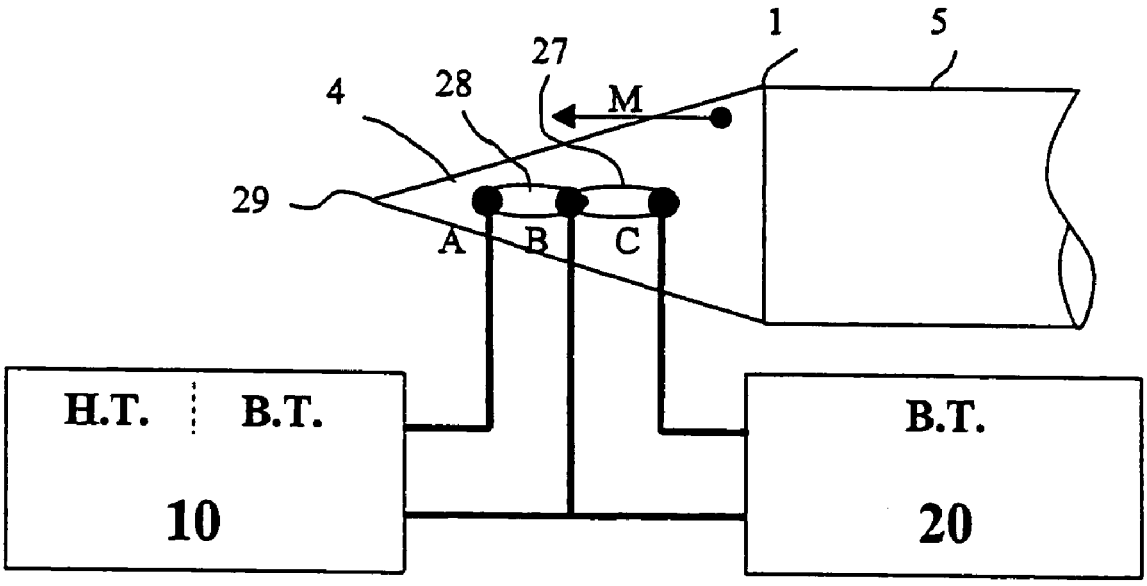
FIG. 6 shows one example of a device for generating a plasma according to an exemplary embodiment.

FIG. 6 shows one embodiment of a device for generating a plasma, the device having two pairs of electrodes (e.g., FIG. 6, elements A and B and elements B and C), and first means 10 for generating a high voltage T1 and a low voltage T3 between electrodes A and B, and second means 20 for generating a low voltage T2 between electrodes B and C. Voltage T1 generated by first means 10 is able to break through the dielectric barrier between electrodes A and B or, in other words, to ionize the gas between these electrodes, then voltage T3 is able to maintain this ionization between the same two electrodes (e.g., A and B), while voltage T2 is able to increase the ionization of said gas between electrodes B and C.

In this embodiment, first means 10 generates a voltage T1 at a level of 10 kV with a low stored energy of approximately 3 mJ followed by a voltage level T3 of 0.55 kV with a stored energy of 12 J, while second means 20 generates a voltage T2 of 0.55 kV with a high stored energy, approximately 50 J, by utilizing a capacitance of 330 μF. The plasma is generated by at least one high-voltage discharge. The discharge may be triggered by a low-level electrical or optical signal outside the present device and the discharge delivers sufficient energy to create the plasma. The design optimizes the electrical energy stored before the voltage pulse appropriate to the plasma discharge conditions is triggered.

FIG. 6 shows an exemplary embodiment of the device for generating a plasma to a hypervelocity projectile of which only the front part, in this case the nose, is represented.

This projectile is assumed to be moving in direction M at a velocity V. The device has three electrodes, one of which is common to the first and second voltage-generating means. These three electrodes C, B, and A are aligned in said direction M.

The operation of this device, to cause the projectile to be deflected in direction Y, is as follows:

The projectile is assumed to be moving in air at a high velocity in direction M perpendicular to direction Y. To deflect the projectile in direction Y, a plasma discharge is generated, this plasma then being supplied with energy. It consists of proceeding, in direction Y and with the aid of a device according to the invention, to create a plasma discharge over a first limited sector 28 of the outer surface of the nose, first sector 28 being delimited by electrodes A and B, then to supply this plasma with energy over a second limited sector 27 of the nose, second sector 27 being delimited by electrodes B and C. To achieve this, a high-voltage discharge is applied by the first means 10 to electrodes A and B, producing a voltage differential T1 between them. This voltage differential is sufficient to break through the dielectric barrier of the air, and generate a microplasma. A low voltage is then applied by first means 10 to electrodes A and B, producing a sufficient voltage differential T3 between them to ionize the air, thus generating a plasma in sector 28. Because of its velocity, the projectile moves relative to the plasma generated. When the plasma is in the second sector 27 delimited by electrodes B and C, successive low-voltage discharges are applied by the second means 20 to electrodes B and C, producing a voltage differential T2 between them. These low-voltage discharges are sufficient to maintain the plasma, i.e. keep it in existence for several milliseconds, long enough to allow the projectile to be deflected.

Figure 7:
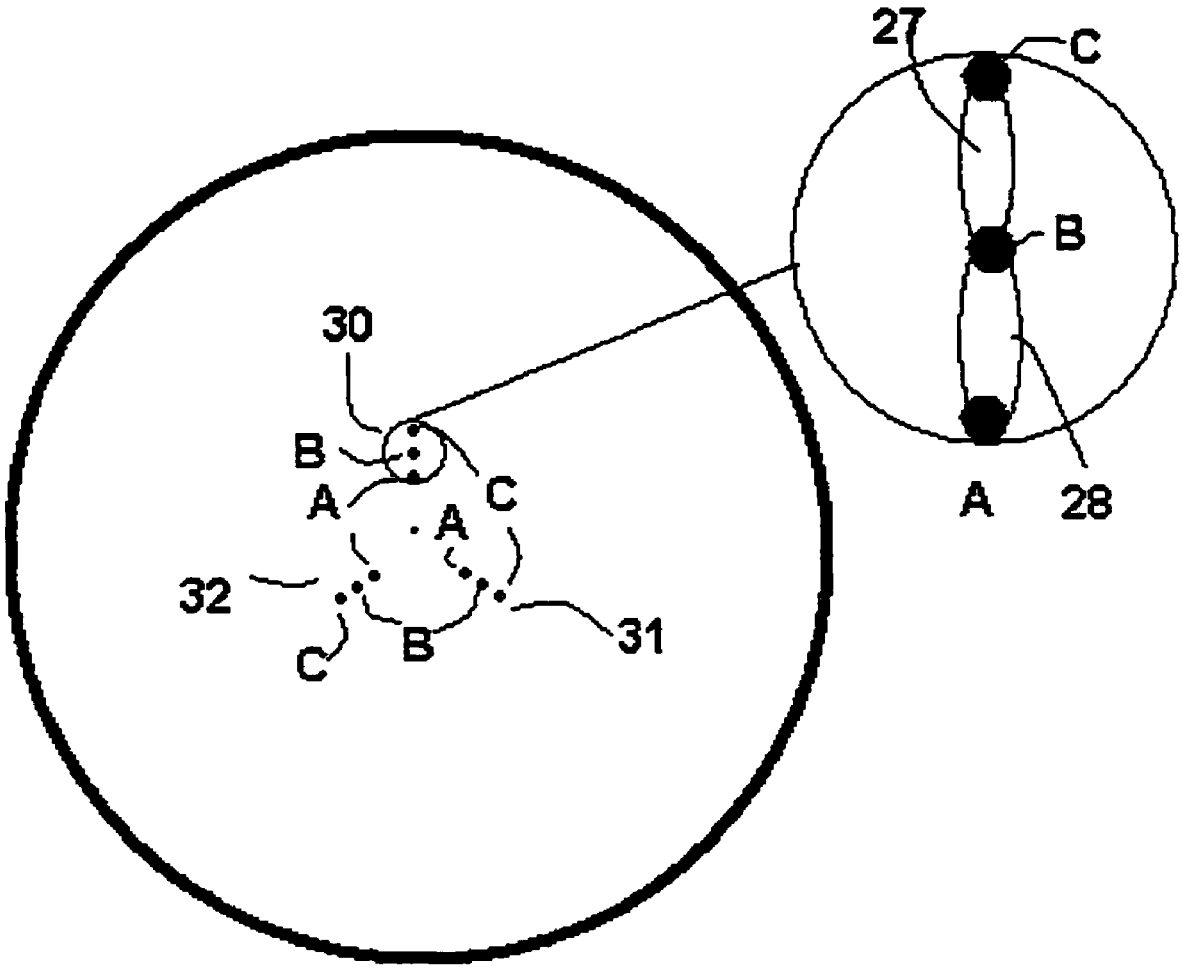
FIG. 7 shows an exemplary layout of three groups of electrodes disposed $2\pi/3$ radians apart.

As shown in FIG. 7 as an example, three groups of electrodes each having three electrodes A, B, and C are distributed over the circumference of the projectile nose. The three pairs of electrodes A and B are each connected to their own first means 10 while the three pairs of electrodes B and C are each connected to their second means 20. Such an arrangement allows the projectile to be deflected in all directions, possibly by combining the groups.

Figure 8:
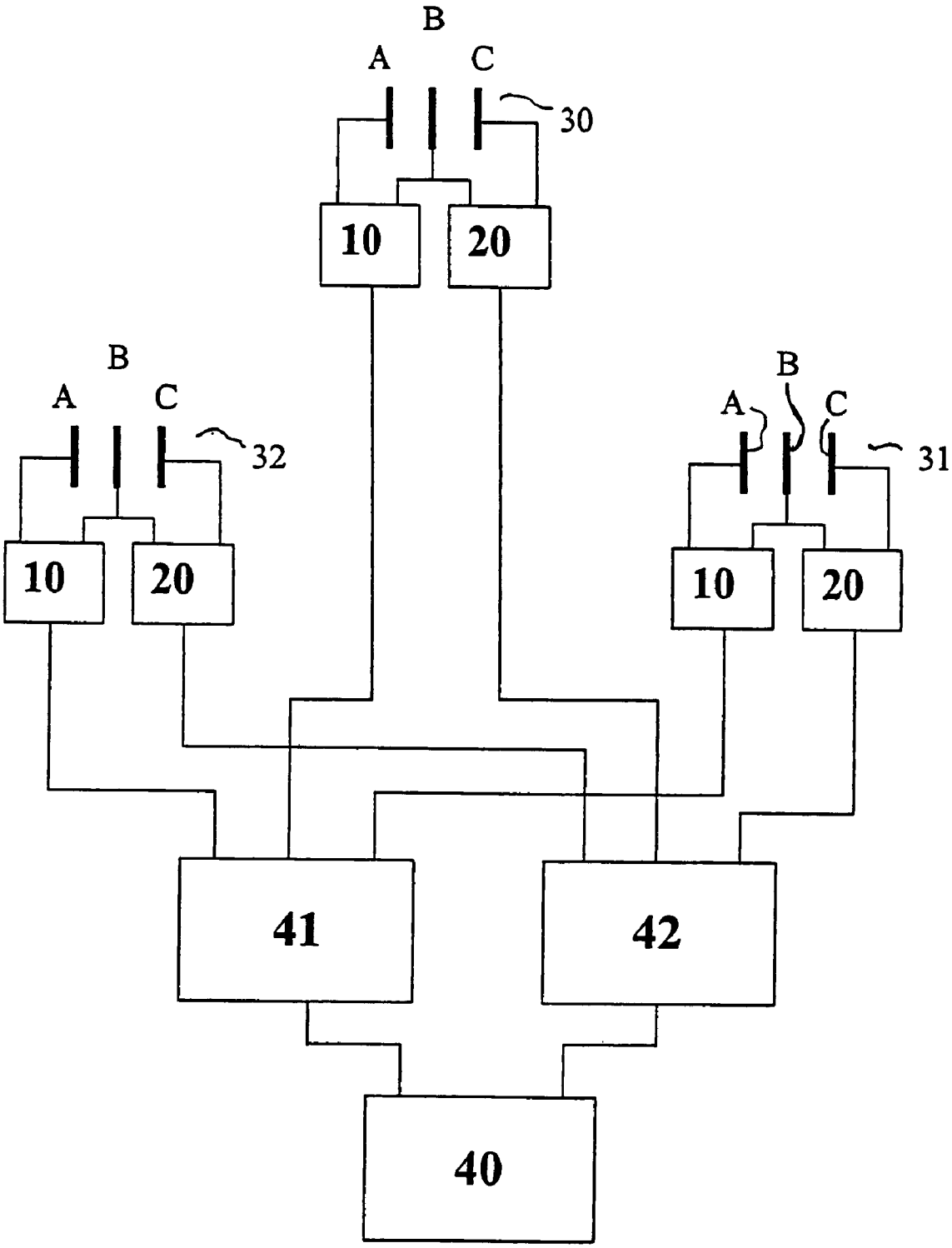
FIG. 8 illustrates a schematic of the electrodes and associated controlling circuit in the exemplary layout depicted in FIG. 6.

FIG. 8 is a diagram of a circuit for controlling the voltage applied to the electrodes disposed in the layout of FIG. 7. This circuit has a control device 40 controlling voltage distributor triggers 41 and 42 that control the first and second voltage generating means 10 and 20, respectively. These generators 10 and 20 are each connected respectively to each of electrodes A and B and the other to each of electrodes B and C.

Thus, control device 40 controls, via distributor triggers 41 and 42 and first and second voltage generating means 10 and 20, not only the generation of an adequate voltage differential (e.g., high voltage then low voltage for first voltage generating means 10 and low voltage for second means 20), but also the delivery of these voltages to the electrode group (e.g., FIG. 8, elements 30, 31, and 32) corresponding to the desired deflection direction.

The drag of the projectile, the force, and the guidance moment can be determined by calculation. Even where the forces are small, this device is useful because, by acting near the tip of the projectile, a small flow asymmetry destabilizes the projectile and enables it to be guided. The use of the same device, or another device according to the invention located at another point on the projectile, can serve to restabilize the projectile on its trajectory.

Moreover, this device can be associated with means for controlling it, for example a GPS system, a self-steering system, a remote control system, or any other system that reports the roll position of the projectile.

As an example, for a projectile with caliber 20 mm flying at ground level under normal conditions at a velocity corresponding to Mach 3.2 whose front portion is a cone with a 20° angle at the tip and a cylindrical part that is not an airfoil, a plasma discharge with a temperature of approximately 15,000 K is produced over a surface of 9 $mm^2$ near the projectile tip, such a plasma discharge requires a momentum drag corresponding to a mass flow of an explosive substance of approximately $15\times10^{-4}$ kg/sec corresponding to a power of approximately 3 kVA. Since the duration of the discharge is between 2 and 4 ms, the electric power is approximately ten joules.

The intensity of the discharge may be modulated by adjusting the plasma discharge's thermodynamic parameters (e.g., the temperature of the discharge and associated momentum drag).

The influence on the aerodynamic effects is of interest. The aerodynamic effects are first evaluated by digital simulation in the case of a non-guided projectile flying on a straight-line trajectory at zero angle of attack. The aerodynamic coefficients are calculated only for the front part of the projectile as the wake is not taken into account:

The drag coefficient is Cx=0.1157. The lift coefficient Cz and the moment coefficient Cm calculated at the projectile tip are zero.

The aerodynamic coefficients are now determined for an embodiment of a projectile flying on a straight-line trajectory at zero angle of attack and guided by a plasma discharge modeled under the conditions set forth above:

The drag coefficient is Cx=0.0949. The lift coefficient is Cz=0.0268 corresponding to a force of 6 N oriented in the direction in which the discharge acts. The moment coefficient calculated at the projectile tip is Cm=−0.0356 corresponding to a moment of −0.1609 mN oriented such as to accompany the effects of the lift force.

Analysis of the results of this simulation shows that:

(1) a reduction in drag of the projectile at the time of the plasma discharge of about 18%, which is very large;

(2) the guidance force acts in the direction of the discharge;

(3) that the pitching moment contributes beneficially to the guidance force to render the projectile maneuverable.

Figure 9:
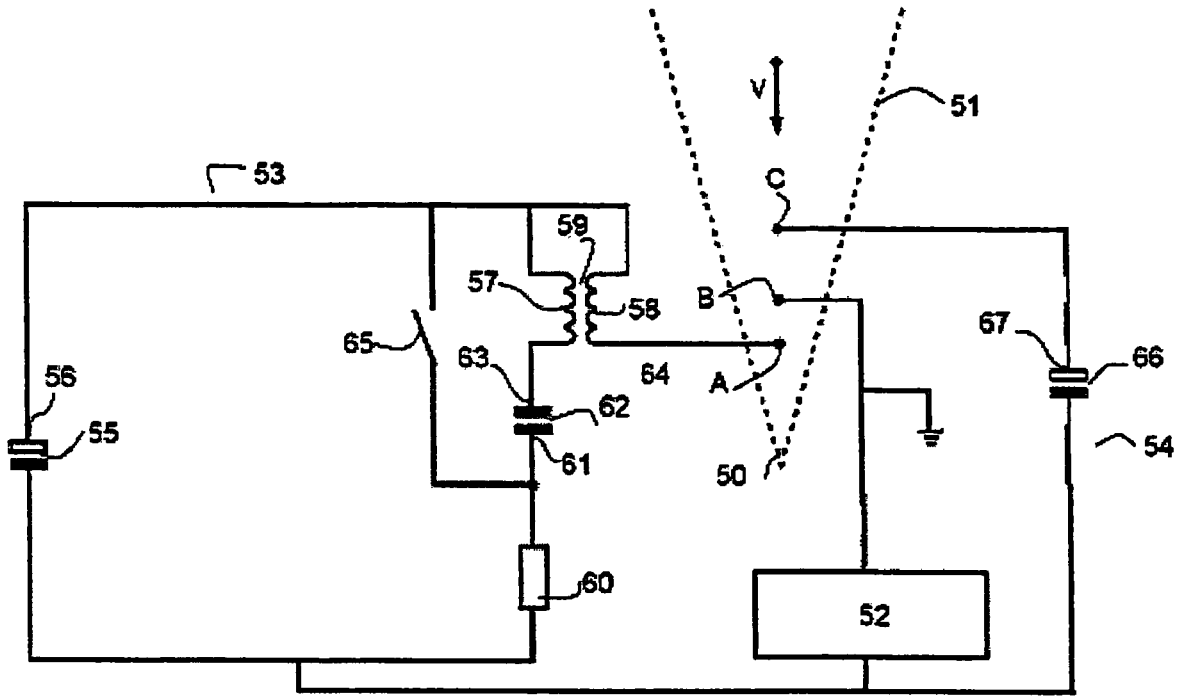
FIG. 9 shows an example of the device in accordance to an exemplary embodiment.

FIG. 9 shows one example of a device according to an exemplary embodiment. For illustration purposes, only the voltage generating means connected to three electrodes A, B, and C, disposed in the same plane passing through the lengthwise axis of the projectile and at the skin and near tip 50 of nose 51 of a projectile is shown.

The voltage generating means is comprised of a low-voltage generator 52 connected to two assemblies 53 and 54 of which one is able to produce a sufficiently high voltage to generate a plasma between the electrodes A and B, and the other is able to produce a low voltage between the electrodes B and C, and is able to supply with energy the plasma generated by the high voltage when the plasma is between electrodes B and C because the projectile has moved.

In first assembly 53, low-voltage generator 52 is connected to a first capacitor 55 whose output 56 is connected to a primary circuit 57 and a secondary circuit 58 of a step-up (i.e., low-voltage to high-voltage, or LV/HV) transformer 59, and is connected to a resistor 60 itself connected to an input 61 of a second capacitor 62 whose output 63 is connected to primary circuit 57 of transformer 59. Also, output 64 of transformer 59 is connected to electrode A while input 61 of capacitor 62 is also connected to output 56 of capacitor 55 via a switch 65.

The second assembly 54 is comprised of a third capacitor 66 whose output 67 is connected to electrode C. Also, electrode B is connected to the ground.

When switch 65 is open, the device depicted in FIG. 9 acts as a low-voltage plasma generator carried on board a projectile flying in the low atmosphere before a plasma discharge is triggered, where capacitors 55 and 66 are being charged at a low voltage, and the low voltage of capacitor 55 being at the terminals of capacitor 62 and on electrode A. Electrode B is connected to ground. Electrode C is subjected to the low voltage of capacitor 66.

A plasma discharge is triggered by closing switch 65. At this time, primary circuit 57 of step-up transformer 59 is subjected to the low voltage of capacitor 62. A high voltage appears instantaneously at the terminals of the secondary circuit 58 of transformer 59 and hence at electrode A. Transformer 59 is configured such that the high voltage at the terminals of its secondary is sufficient to break through the dielectric barrier between electrodes A and B.

When the dielectric barrier is broken between electrodes A and B, capacitor 55 discharges through the secondary circuit 58 of transformer 59 and supplies the plasma between electrodes A and B with at least one low voltage discharge.

Since the projectile is moving, the volume of ionized gas between electrodes A and B reaches electrode C like a sliding contact. When the ionized gas reaches electrode C, there is conduction between electrodes C and B and a powerful plasma is generated and maintained by a low voltage discharge from capacitor 66.

FIGS. 10*a* to 10*f* show the various steps and substeps of the operation of a device according to FIG. 9.

Figure 10A:
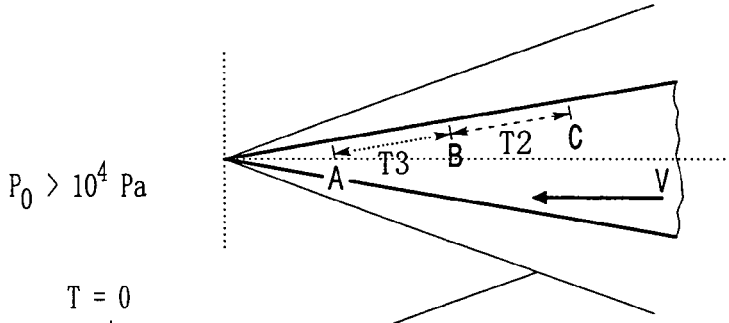
FIGS. 10*a*-10*f* show the various operational stages and substages of a device according to FIG. 9.

FIG. 10*a* shows the status of a projectile flying in the low atmosphere before a plasma discharge is applied. Before application of the high-voltage discharge T1, a low voltage T3 is applied to the terminals of electrodes A and B and a high-energy low voltage T2 is applied to the terminals of electrodes B and C; these low voltages are insufficient to break through the dielectric barrier between these electrodes A and B and B and C, so it is impossible for the plasma discharge to occur without triggering.

Figure 10B:
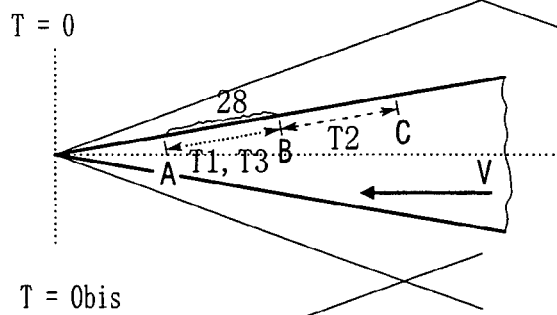
Figure 10C:
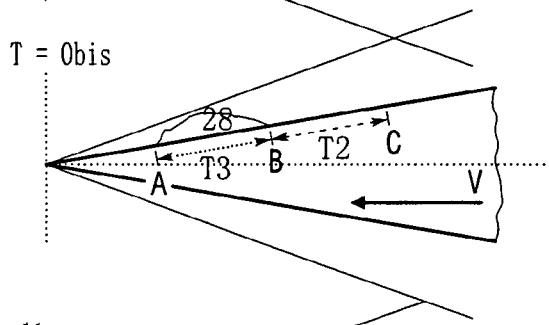
Figure 10D:
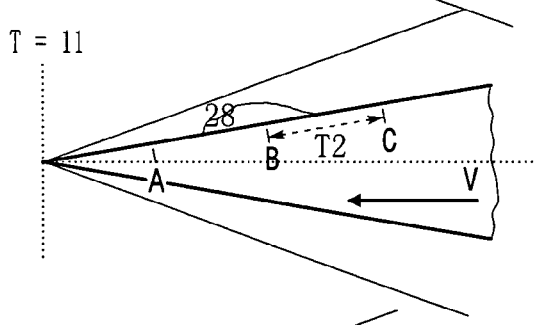

FIGS. 10*b* and 10*c* correspond to the first step of the invention. To satisfy the constraints of discharge time, miniaturization, and autonomy of the system, the new device on board is based on the use of low-voltage currents but requires a minimum of high-voltage current to bring about the discharge between electrodes A and B and B and C (in accordance to Paschen's curve).

As shown in FIG. 10*b*, the gas surrounding the projectile is ionized between electrodes A and B in sector 28 for a very short amount of time with the aid of a step-up transformer; the dielectric barrier between the two electrodes A and B is then broken. A plasma discharge, shown in FIG. 10*c*, is generated, releasing a small amount of energy stored in low-voltage capacitor 55.

Since the projectile is moving in gas, the volume, previously ionized in first sector 28, moves toward electrode C; this is possible only because the projectile is moving relative to the surrounding gas. This state is shown schematically by time t1 in FIG. 10*d*.

Figure 10E:
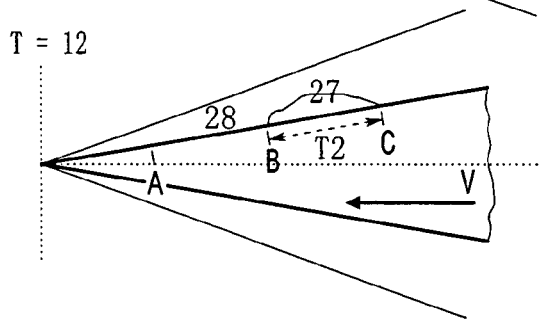
Figure 10F:
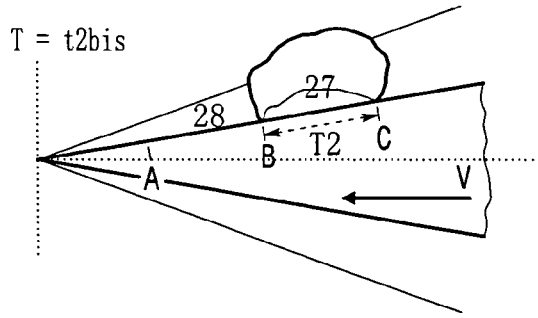

FIGS. 10*e* and 10*f* correspond to the second step of the invention. When the ionized gas covers electrodes B and C (FIG. 10*e*), the breakdown voltage decreases. This status corresponds to time t2. The second step includes applying the low voltage to the terminals of electrodes B and C to trigger another plasma discharge between electrodes B and C. Ionization of the first plasma is amplified in second sector 27, giving off a large amount of energy (FIG. 10*f*) stored in low-voltage capacitor 66. This status corresponds to time t2*bis*. The first plasma discharge described in the first step thus serves as a sliding switch for the second power plasma discharge.

Numerous modifications can be made without departing from the framework of the invention. Thus, the shape of the nose can be any shape and not necessarily a shape of revolution. The invention can also be applied to sectors not located on the nose of the projectile, and can be on the cylindrical surface, on fin assemblies, or on airfoils of the projectile. Furthermore, several electrodes, preferably disposed in parallel, can be used to generate a plasma and/or several electrodes, preferably disposed in parallel, can be used to maintain one or more generated plasmas.

In addition, within a given group of electrodes, numerous dispositions of said first, second, third, and fourth electrodes are possible. Thus, the first and second electrodes can be aligned longitudinally or be disposed perpendicularly or take a position intermediate between these two positions.

The same applies to the third and fourth electrodes. However, in all cases, at least part of the sector delimited by the third and fourth electrodes is further from the end of the projectile nose than that delimited by the first and second electrodes. In the case where the first and second electrodes are disposed perpendicularly to the lengthwise axis of the projectile, the angle formed by the lengthwise axis and these electrodes can reach $\pi$ Rd if these electrodes are positioned at the projectile nose. However, each group of electrodes can be positioned at any other point of the projectile to be determined for each particular application and depending on the mission assigned thereto.

The invention claimed is:

1. A method for deflecting, in a direction Y perpendicular to a lengthwise axis of a projectile, a hypervelocity projectile operating in a gas having a generally cone-shaped nose with a substantially pointed tip, comprising:

generating a first high-voltage discharge able to produce a plasma over a first limited sector of a surface of the projectile and in the direction Y;

maintaining the plasma; and generating a low-voltage discharge to supply the plasma with energy over a second limited sector of the surface of the projectile and in the direction Y, wherein the first and second sectors have non-overlapping area.

2. The method according to claim 1, wherein the plasma is maintained over the second sector for at least one millisecond.

3. The method according to claim 1, comprising:

applying at least a first voltage discharge T1 between a first set of at least two electrodes delimiting the first limited sector of the projectile surface in the direction Y, wherein the first voltage discharge T1 is able to break through a dielectric barrier between the first set of at least two electrodes;

applying a voltage T3 between the first set of at least two electrodes able to generate a plasma; and applying a voltage T2 between a second set of at least two electrodes delimiting the second limited sector of the projectile surface in the direction Y, the voltage T2 being able to supply the plasma with energy.

4. The method according to claim 3, wherein the voltage T2 is generated over a sector further from the end of the nose of the projectile than the first sector.

5. The method according to claim 4, wherein the first voltage discharge T1 is a high-voltage discharge.

6. The method according to claim 4, wherein the voltage T2, applied between the second set of at least two electrodes delimiting the second limited sector and able to maintain the plasma, is a low voltage.

7. The method according to claim 3, wherein the voltage T3, applied between the first set of at least two electrodes and able to generate the plasma, is a low voltage.

8. The method according to claim 1, wherein the first high-voltage discharge is at least 5 kV and the low-voltage discharge is less than 1000 V.

9. The method according to claim 1, wherein the high-voltage discharge is followed by a plurality of successive low-voltage discharges.

10. The method according to claim 1, further comprising: generating a plasma over the first limited sector of the nose of the projectile and maintaining the plasma on the second limited sector of the projectile nose.

11. A hypervelocity projectile having a generally cone-shaped nose, having a substantially pointed tip and a discharge means able to emit a plasma discharge in a limited sector of the outer surface of the projectile, wherein the discharge means comprises at least one group of at least three electrodes.

12. The projectile according to claim 11, wherein the discharge means comprises at least one group of at least three aligned electrodes.

13. The projectile according to claim 12, wherein the discharge means comprises at least one group of at least three electrodes aligned in a direction M parallel to the straight-line movement of the projectile.

14. The projectile according to claim 12, further comprising:

a first means able to ignite a plasma; and a second means able to supply the plasma with energy.

15. The projectile according to claim 14, further comprising at least a first and a second electrode that are connected to a first voltage generating means able to generate a high voltage.

16. The projectile according to claim 15, wherein the first voltage generating means comprises a low-voltage generator and at least one low-voltage capacitor.

17. The projectile according to claim 14, further comprising at least two electrodes connected to a second voltage generating means able to generate a low voltage.

18. The projectile according to claim 17, wherein the second voltage generating means comprises a low-voltage generator and at least one low-voltage capacitor.

19. The projectile according to claim 17, wherein at least one of a first and a second electrode connected to a first voltage generating means, able to generate a high voltage, is closer to the end of the nose of the projectile than the electrodes connected to the second voltage generating means.

20. The projectile according to claim 19, wherein one of the electrodes is common to the first and second means for generating a voltage.

21. The projectile according to claim 11, wherein the electrodes are positioned on the surface of the projectile based on a particular application assigned to the projectile.

22. A hypervelocity projectile having a generally cone-shaped nose and a substantially pointed tip, comprising:

a device for guiding the hypervelocity projectile having a means to emit a plasma discharge in a limited sector of a projectile outer surface, wherein the emitting means comprises at least one group of at least three electrodes.

* * * * *